United States Patent [19]

Held

[11] Patent Number: 4,711,168

[45] Date of Patent: Dec. 8, 1987

[54] SEALING ARRANGEMENT FOR A DOUBLE BAND PRESS

[76] Inventor: Kurt Held, Alte Strasse 1, D-7218 Trossingen 2, Fed. Rep. of Germany

[21] Appl. No.: 808,935

[22] Filed: Dec. 13, 1985

[30] Foreign Application Priority Data

Dec. 14, 1984 [DE] Fed. Rep. of Germany ..... 3445636

[51] Int. Cl.[4] ..... B30B 5/06

[52] U.S. Cl. ..... 100/154; 100/93 RP; 156/583.5; 277/27; 277/71; 277/73; 277/181; 277/235 A

[58] Field of Search ..... 100/151, 154, 93 RP; 156/582, 583.5; 425/371; 277/27, 71, 73, 165, 227, 223, 224, 235 A, 181, 182, 236, DIG. 6

[56] References Cited

U.S. PATENT DOCUMENTS

| | | | |
|---|---|---|---|
| 684,617 | 10/1901 | Rathbun | 277/224 |
| 3,615,099 | 10/1971 | Prasse | 277/235 A |
| 3,620,158 | 11/1971 | Torelli et al. | 100/154 |
| 4,285,525 | 8/1981 | Held | 100/93 RP |
| 4,541,889 | 9/1985 | Held | 100/93 RP |

FOREIGN PATENT DOCUMENTS

| | | |
|---|---|---|
| 565642 | 12/1932 | Fed. Rep. of Germany . |
| 1700136 | 12/1970 | Fed. Rep. of Germany . |
| 2421296 | 11/1975 | Fed. Rep. of Germany . |
| 3126969 | 1/1983 | Fed. Rep. of Germany . |

*Primary Examiner*—Peter Feldman

*Attorney, Agent, or Firm*—Toren, McGeady & Associates

[57] ABSTRACT

A double band press is used for processing a continuous sheet material passing through the press. The press includes a rigid press frame including reversing drums mounted in bearing supports on the frame. An upper and a lower endless press belt run over different ones of the drums and each press belt in combination with a pressure plate and sliding seal form a pressure chamber for exerting pressure against a reaction zone located between adjacent runs of the press belts. The sliding seal is positioned within a groove in the pressure plate and is displaceable and is pressed toward the inner surface of the press belt. A fluid pressure medium in the pressure chamber provides the pressing action on the press belt. The sliding seal includes a metal body with a surface facing the inner surface of the press belt and a dry surface layer is provided in the surface facing the press belt so that the dry surface layer is in sliding frictional contact with the press belt.

11 Claims, 4 Drawing Figures

SEALING ARRANGEMENT FOR A DOUBLE BAND PRESS

BACKGROUND OF THE INVENTION

The present invention is directed to a double band press in which a continuously running sheet material is processed and comprises a rigid press frame in which reversing rollers or drums are rotatably supported in bearing supports mounted on the press frame. An endless upper press belt and an endless lower press belt are trained over different reversing drums. Within each of the press belts there is a pressure plate which faces one run of the press belt and forms, in combination with the press belt and a sliding seal, a pressure chamber for a pressure medium used in applying pressing force to the press belt. The sliding seal is positioned within a groove formed in the surface of the pressure plate so that the seal is displaceable relative to the inside surface of the associated press belt and can be pressed with a certain amount of force against the press belt. A fluid pressure means is contained within the pressure chamber bearing against the sliding seal and generating a pressing action on the press belt.

Double band presses, such as disclosed in German Offenlegungsschrift No. 24 21 296, are known for producing continuous sheet material, such as laminates, chip boards, fiber boards, electrolaminates and the like.

Elastomers resistant to approximately 200° C. are used as sealing materials in sliding seals for these presses. Further, it is known in the German Pat. No. 27 22 197 to secure elastomers, pressure-setting plastics or thermoplastic seal materials in U-shaped retaining members formed of high tensile strength metal. Support angles secured in transverse bearings in the pressure plate, are fastened to the sides of the retaining members at selected distances from one another. In this arrangement friction forces are introduced into the pressure plate from the sliding seal through the retaining members and the support angles. Finally, it is known from German Pat. No 29 53 078 to arrange two sliding seals in mutually spaced relation to one another and to utilize the space between the seals for collecting pressure medium which flows out of the pressure chamber. In these sealing arrangements friction forces are introduced into the pressure plate through the retaining members and the support angles.

A common feature of all the known sealing arrangements is that the seal is formed of a relatively easily deformable material, such as an elastomer. Since the friction forces developed at the seal in the operation of the double band press far exceed the maximum allowable tensile or shearing stresses for the sealed material, the seal would be immediately destroyed if the friction forces were not introduced into the pressure plate by the retaining members and support angles. There is the disadvantage, however, that the known construction is costly in terms of design and manufacturing technology. Moreover, the pressure and temperature conditions existing in the double band press are in the upper region of the values for an elastomer sealing material. Therefore, even slight changes in these operating conditions can lead to destruction of the seal.

Another disadvantage of the organic sliding seal material used in double band presses is the poor thermal conductivity. As a result of such poor thermal conductivity, the friction heat developed by the contact of the seal with the press belt surface cannot flow into the pressure plate, rather it flows into the material to be pressed through the press belt. This characteristic leads to local linear overheating of the press belt and eventually leaves an undesirable visible stripe on the surface of the material being pressed and the stripe must be removed by trimming the border of the pressed material. As a result, there are considerable losses in material.

SUMMARY OF THE INVENTION

It is the primary object of the present invention to improve sliding seals in a double band press so that the seals are more capable of offering resistance to pressure and temperature and the seals can be more easily produced and afford a more effective conduction of friction heat.

In accordance with the present invention, the sliding seal is formed of a metal body facing toward the pressure plate and a dry sliding layer deposited on the metal body and facing the inside surface of the press belt so that the dry sliding layer is in frictional contact with the inside surface of the press belt.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
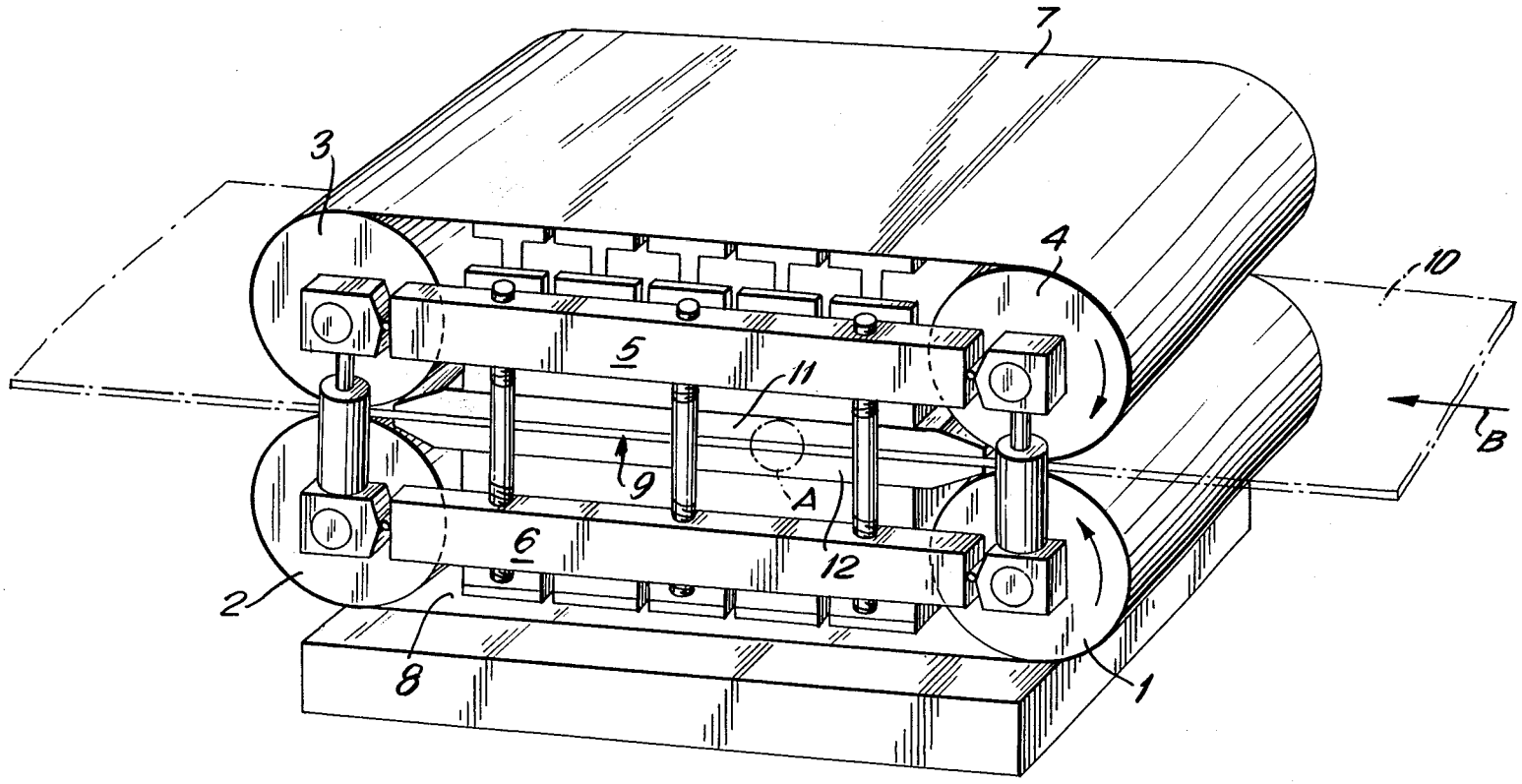
FIG. 1 is a schematic side view of a double band press.

In FIG. 1 a double band press is shown schematically for use in the continuous production of laminates and it includes four deflecting or reversing rollers 1, 2, 3 and 4 rotatably supported at both ends in bearing supports 5, 6. An upper endless press belt 7 extends around the upper rollers or drums 3, 4 and a lower endless press belt 8 extends around the lower drums 1, 2. The press belts are usually formed of a high tensile steel band. The direction of rotation of the drums is indicated at the ends of the drums 1, 4 by arrows. A reaction zone 9 is formed between the lower run of the upper press belt and the upper run of the lower press belt with a material sheet 10 passing through the reaction zone from the right to the left as viewed in FIG. 1. The material sheet 10, for example, may be formed of laminates impregnated with plastics material such as a synthetic resin, fiber-binding agent mixtures or the like which are compressed by the combined application of pressure and heat. Compression without any thermal action or by undercooling is also possible.

The pressure directed against the material sheet 10 can be applied hydraulically to the inner surfaces of the endless press belts 7, 8 by pressure plates 11, 12 and is transferred from the belts to the material sheet 10. Reaction forces exerted by the material sheet are transferred into the press frame, shown only schematically, through the pressure plates 11, 12 and the support members connected with the plates. The reversing drums 1, 4 arranged at the input side of the press are heated and in turn heat the press belts 7, 8. The heat is transmitted through the belts into the reaction zone 9 where it is supplied to the material sheet 10 and serves to cure plastics material with which the material sheet is impregnated.

The pressing force is provided on the material sheet 10 in the reaction zone 9 by a fluid pressure medium introduced into the space between the pressure plates 11, 12 and the adjacent inside surfaces of the press belt located between the drums which portions of the belts form the reaction zone. The space forming the so-called pressure chamber is defined laterally by sliding seals. A synthetic oil capable of withstanding the operating conditions of temperature and of pressure in the double band press can be used as the pressure medium. In place of a liquid pressure medium, a gas, such as compressed air, could be used.

Figure 2:
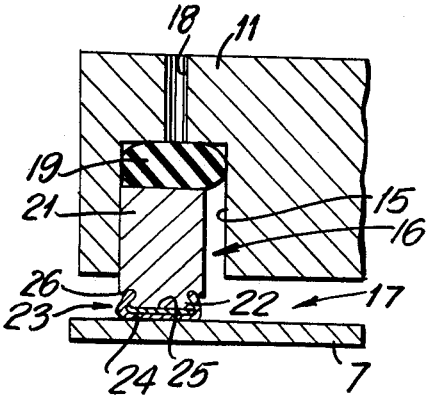
FIG. 2 is a partial sectional view of the double band press in FIG. 1 illustrating a pressure plate and a sliding seal contacting a press belt in the region A shown encircled in FIG. 1.

In FIG. 2 the border region of a pressure chamber corresponding to the encircled region A in FIG. 1 is depicted with the seal laterally closing the chamber extending in the forward running direction of the material sheet 10. The edge or border of the pressure plate 11 which is parallel to the forward running direction of the material sheet, note arrow B in FIG. 1, has a groove 15 extending parallel to the border and containing a sliding seal 16. The sliding seal is arranged to be displaceable vertically relative to the inside surface of the press belt 7 facing toward the pressure plate. The pressure within the pressure chamber 17 between the pressure plate 11, the inside surface of the press belt 7 and the sliding seal 16 holds the sliding seal in contact with one of the inner walls of the groove 15, that is, the left-hand wall as viewed in FIG. 2, so that the seal is slidingly displaceable. A borehole 18 opens into the base of the groove 15 so that a pressure source can act through the borehole 18 on an elastic O-ring 19 located in the base of the groove. The pressure developed in the base of the groove presses the O-ring 19 against the seal 16 and, in turn, presses the seal against the inside surface of the press belt 7 so that the pressure chamber is sealed against the ambient atmosphere side of the arrangement, that is, the left-hand side as viewed in FIG. 2. The contact pressure of the seal against the press belt can be effected in other ways, for example, by means of a spring.

The groove 15 extends around the pressure plate 11 parallel to its edge or border. Accordingly, the sliding seal 16 is in the form enclosing frame located below the O-ring 19.

The sliding seal 16 is fixed in the long direction of the groove 15, that is, the forward running direction B, and contacts the inside surface of the press belt which moves under the seal at a forward feed speed. Due to the relative movement of the press belt 7 and the sliding seal 16, a friction force develops proportional to the contact pressure and to the sliding friction coefficents. This friction force must be absorbed by the material of the seal 16 without deformation of the seal in an improper manner, otherwise it would not afford the requisite sealing function.

In FIG. 2 the arrangement of a first embodiment of a sliding seal, in accordance with the present invention, is displayed. Seal 16 includes a body 21 formed of a metallic material, preferably a high tensile steel. The cross-section of the body as viewed in FIG. 2 is substantially rectangular with the addition of profiled base 22. A sliding surface formed as a sliding cap 23 is fitted on and securely connected to the base 22. The sliding cap is formed of a composite material and includes a dry sliding layer 24 and a carrier layer 25.

The carrier layer 25 of the composite material is a copper plated steel band which is particularly advantageous for the production of the sliding cap. Tin bronze is porously sintered on the surface of the band and its pores are filled in a rolling and sintering process with a mixture of polytetrafluorethylene and lead so that a coherent cover layer of the polytetrafluorethylene and lead results. This applied layer forming the outside surface of the cap acts as a dry sliding layer due to the friction reducing characteristics of the polytetrafluorethylene and lead mixture with the sintered frame of the tin bronze layer serving to protect or armor the sliding layer.

Another suitable material for the sliding cap is a composite material made up of a steel backing member on which a copper alloy is applied, as a metal matrix obtained through powder metallurgy. Graphite is embedded in the pores of the applied layer and serves as a dry lubricant.

In the embodiment of the sliding seal 16 displayed in FIG. 2, recesses 26 are formed in both sides of the body 21 at the transition with the base 22. The sliding cap 23 is secured to the base 22 with the carrier layer 25 bearing against the base 22 and with the dry sliding layer facing toward the inner surface of the press belt 7 and with the opposite edges of the cap being fitted into the recesses 26. Accordingly, the sliding cap 23 is firmly anchored to the base 22 by plastic deformation. Additional undercuts can be provided to reinforce the attachment of the cap 23 to the base 22.

Figure 3:
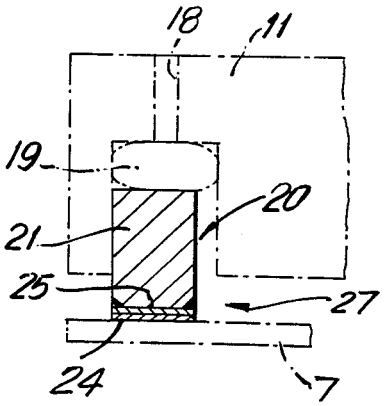
FIG. 3 is another partial sectional view displaying another embodiment of a sliding seal.

Another embodiment of the present invention is shown by sliding seal 20 in FIG. 3. Sliding seal 20 is formed of a metallic body 21, such as a high tensile steel. The body 21 has a rectangular cross-section as viewed in FIG. 3 with a sliding cap 27 attached to the surface of the body facing the press belt 7 so that the cap is made up of a carrier layer 25 supporting a dry sliding layer 24 forming a pair of flat layers on the body 21. The carrier layer 25 is welded along its two edges to the body 21, such as by YAG laser welding. The welding could be replaced by brazing.

The friction forces developed at the sliding seal 16 or 20 during operation of the double band press are absorbed in the body 21. Since the body 21 is formed of metal having a modulus of elasticity greater by several orders of magnitude than an elastomer, duroplastic or thermoplastic material, practically no deformation occurs due to the friction forces. Accordingly, the sealing function is maintained as desired. Since the body 21 as well as the covering provided by the sliding cap 23, 27 with the dry sliding layer 24 has a metallic thermal conductivity, the heat developed by the friction of the seal with the surface of the belt is directed into the pressure plate 11 with which the sliding seal has a tight metallic contact because of the pressure acting in the pressure chamber 17, note FIG. 2. Accordingly, no partial overheating occurs in the material sheet 10 which could lead to overhardening.

Figure 4:
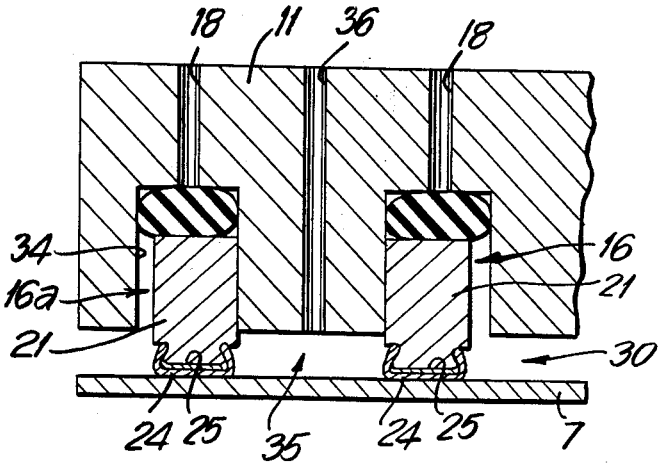
FIG. 4 is a partial sectional view similar to FIG. 2, however, illustrating two adjacent sliding seals mounted in a pressure plate.

Due to the texture of the contacting surfaces of the press belts 7, 8 and the dry sliding layer 24 there may be small quantities of the fluid pressure medium which leaks out of the pressure chamber 17. To collect such leakage a pair of sliding seals 16 (or 20) can be positioned adjacent to one another in a spaced apart manner to provide another embodiment of the invention as shown in FIG. 4. In this embodiment, the pressure chamber 30 is defined between the pressure plate 11 and the press belt 7 and laterally by the sliding seals 16. On the side exposed to the atmosphere, that is, the left-hand side in FIG. 4, another seal 16*a* is arranged in a groove 34 in the pressure plate so that it extends parallel to the seal 16 with a space 35 provided between the seals so that any pressure medium flowing into the space can be collected. The pressure medium can be conducted out of the space 35 through a borehole 36 extending through the pressure plate 11. To reinforce the suction or removal action, the borehole 36 can be connected to a partial vacuum source.

While specific embodiments of the invention have been shown and described in detail to illustrate the application of the inventive principles, it will be understood that the invention may be embodied otherwise without departing from such principles.

I claim:

1. Double band press for pressing a continuously running sheet material comprising a rigid press frame, bearing supports mounted on said press frame, reversing drums mounted in said bearing supports and arranged as at least one pair of spaced upper drums and at least one pair of spaced lower drums, an upper endless press belt entrained around said upper drums and a lower endless press belt entrained around said lower drums, each said press belt having an outer surface and an inner surface with said outer surfaces disposed in facing relationship forming a reaction zone therebetween through which the sheet material passes a pressure plate located within each said press belt and extending in the direction between said reversing drums, said pressure plates spaced closely from the inside surfaces of said press belts adjacent to said reaction zone, said pressure plates each having a surface facing the associated inner surface of said press belt and said surface being bordered by an edge, a groove formed in said surface of said pressure plate and spaced inwardly from said bordering edge, a sliding seal located within said groove and extending out of said groove into contact with said inner surface of the associated said press belt, means within said groove for pressing said seal against the inner surface of said press belt, the combination of the surface of said pressure plate facing the inner surface of the associated said press belt and said sliding seal forming a pressure chamber, fluid pressure means within said pressure chamber for pressing said press belt toward said reaction zone, wherein the improvement comprises that said sliding seal comprises a body formed of metal located within said groove and being displaceable within said groove toward the inner surface of the associated press belt, said sliding seal having a first surface facing the inner surface of said press belt, a dry metal layer forming the first surface of said sliding seal and arranged to engage the inner surface of said press belt in sliding contact, said dry metal layer is supported on said body and is formed of a different metal than said body.

2. Double band press, as set forth in claim 1, wherein said body of said seal is formed of steel.

3. Double band press, as set forth in claim 1 or 2, wherein a carrier layer is positioned between and is in contact with said body and said dry sliding layer.

4. Double band press, as set forth in claim 3, wherein said carrier layer is formed of a steel band with a porously sintered coating of tin bronze having pores therein, and a mixture of polytetrafluorethylene and lead filling the pores in said tin bronze and forming said dry sliding layer.

5. Double band press, as set forth in claim 3, wherein said dry sliding layer comprises a copper alloy forming a metal matrix prepared by powder metallurgy with said copper alloy layer having pores therein with the pores containing graphite.

6. Double band press, as set forth in claim 1, wherein said body of said sliding seal has a rectangular cross-section.

7. Double band press, as set forth in claim 1, wherein said body of said sliding seal includes a shaped base adjacent to the inner surface of said press belt, recesses formed inwardly at the junction between said body and said base, a sliding cap including said dry sliding layer is fixed to said base, said cap having a pair of opposite sides extending in the long direction of said seal, and the sides of said sliding cap being deformed into said recesses for anchoring said cap to said base.

8. Double band press, as set forth in claim 3 wherein each of said dry sliding layer and carrier layer has a rectangular cross section with said carrier layer being welded to one side of said body.

9. Double band press, as set forth in claim 3, wherein each of said dry sliding layer and carrier layer has a rectangular cross section with said carrier layer being brazed to one side of said body.

10. Double band press, as set forth in claim 1, 2, 6, 7, 8 or 9, wherein a pair of said sliding seals are disposed in generally parallel relation around the bordering edge of said pressure plate with one said seal located closer to said pressure chamber than the other so that the other said seal is located outside of said pressure chamber, said sliding seals being spaced apart and forming a space therebetween also defined by said pressure plate and the inside surface of said press belt, whereby any possible leakage of pressure medium out of said pressure chamber is collected in said space, and means for removing any leakage from said space.

11. Double band press, as set forth in claim 10, wherein a borehole is provided through said pressure plate opening into the space between said sliding seals, and said borehole arranged to be connected to a subatmospheric source for withdrawing leakage from said space.

* * * * *